US006023599A

United States Patent [19]

Matsuzaka et al.

[11] Patent Number: 6,023,599

[45] Date of Patent: Feb. 8, 2000

[54] POSITIONING MECHANISM FOR DEVELOPING UNIT IN IMAGE FORMING APPARATUS

[75] Inventors: Satoshi Matsuzaka; Takeshi Okoshi; Masayuki Nishimura, all of Saitama, Japan

[73] Assignee: Fuji Xerox Co., Ltd., Tokyo, Japan

[21] Appl. No.: 09/244,897

[22] Filed: Feb. 4, 1999

[51] Int. Cl.[7] ..... G03G 15/01

[52] U.S. Cl. ..... 399/227; 399/222

[58] Field of Search ..... 399/53, 54, 55, 399/226, 227, 228, 222, 223, 236

[56] References Cited

U.S. PATENT DOCUMENTS 4,297,027 10/1981 Stemme et al. ..... 355/27

5,552,877 9/1996 Ishikawa et al. ..... 399/227

*Primary Examiner*—Arthur T. Grimley

*Assistant Examiner*—Hoang Ngo

*Attorney, Agent, or Firm*—Finnegan, Henderson, Farabow, Garrett & Dunner, L.L.P.

[57] ABSTRACT

An image forming apparatus for developing an electrostatic latent image formed on an image carrier, which is rotatable around an central shaft thereof, with plural colors of toner comprises a developing unit assembly an outer peripheral portion of which retains a plurality of developing units each of which includes a developing roller being to be contacted with the image carrier to supply the associated color of the toner thereon, the developing unit assembly rotatable around a central shaft thereof, a first drive member for rotatively driving the developing roller positioned at a contact position of the developing roller and the image carrier, a second drive member for rotatively driving the developing unit assembly to subsequently position each of the developing roller at the contact position so a rotational direction of the developing unit assembly as to be opposed to a rotational direction of the developing unit assembly according to a reaction force derived from the driving of the first drive member.

8 Claims, 11 Drawing Sheets

POSITIONING MECHANISM FOR DEVELOPING UNIT IN IMAGE FORMING APPARATUS

BACKGROUND OF THE INVENTION

The present invention relates to an electrophotographic image forming apparatus, and more particularly to an image forming apparatus which is capable of maintaining appropriate relative positions between an image carrier and a developing unit which uses toner to develop an electrostatic latent image formed on the image carrier.

Image forming apparatuses, such as electrophotographic copying machines and printers, include apparatuses for visualizing an electrostatic latent image formed on an image carrier (hereinafter typified by a "photosensitive member"), such as a photosensitive drum, by a developing unit thereof as a toner image so as to directly transfer the toner image on a recording medium. Apparatuses of another type are known each of which incorporates an intermediate transfer member which comprises a drum or an endless-film-type belt member and to which the toner image is temporarily and primarily transferred. The primarily-transferred toner image is secondarily transferred to the surface of a recording medium.

FIG. 1 is a diagram showing an example of the image forming apparatus. Referring to the drawing, a charging roller 8, an exposing unit 5, a developing unit assembly 10, a primary transfer roller 2 and a cleaner unit 11 are disposed around a photosensitive member 1 which is rotated by a motor (not shown) in a direction indicated by an arrow B. The developing unit assembly 10 incorporates four developing units 10Y, 10M, 10C and 10K for performing a full-color developing process. Each of the developing units 10Y, 10M, 10C and 10K corresponding to toners in yellow (Y), magenta (M), cyan (C) and black (K) for developing a latent image on the photosensitive member 1 has an interchangeable toner cartridge, a developing roller for imparting a developing bias, a toner supply unit for supplying the toner to the developing roller and a moving unit (each of which is not shown). When latent images corresponding to the foregoing colors are developed, a motor (not shown) is rotated to sequentially rotate the developing unit assembly 10 by an angular degree of 90° in a direction opposite to the direction B, that is, in a direction indicated by an arrow A. Thus, positioning is performed to cause the developing roller in a required color to be brought into contact with the photosensitive member 1.

Toner images in the foregoing colors are sequentially formed on the photosensitive member 1, the toner images being sequentially transferred to the surface of an intermediate transfer belt (hereinafter simply called a "belt") 3 by the primary transfer roller 2 so that toner images in the four colors are superimposed. The belt 3 is arranged among rollers 12, 13, 14 and 15. The roller 12 serves as a drive roller, the roller 13 serves as a tension roller for imparting a tension to the belt 3 and the roller 14 serves as a backup roller for the secondary transfer roller 4. A cleaner 16 for removing toner left on the belt 3 is disposed at a position opposite to the roller 15 across the belt 3.

Recording paper drawn from the recording sheet cassette 17 or 18 by the drawing roller 19 or 20 is moved to a contact portion (or a secondary transferring portion) between the secondary transfer roller 4 and the belt 3 by roller pairs 21, 22 and 23. Urging of the secondary transfer roller 4 toward the roller 14 is suspended, and thus the secondary transfer roller 4 is retracted to a downward position until a secondary transferring operation is performed. When the secondary transference is performed, the secondary transfer roller 4 is brought into contact with the belt 3. Thus, a toner image formed on the belt 3 is, in the contact portion, transferred to the surface of the recording paper, and then fixed with heat in a fixing unit 24. Then, the recording paper is discharged to a tray 25 or a tray 26 (disposed on the upper surface of the apparatus).

A reflecting-type optical sensor 6 is disposed opposite to the belt 3 so as to detect a light beam reflected by a marking (not shown) in the form of aluminum foil disposed on the surface of the belt 3. An output of the reflecting-type optical sensor 6 is used as a reference signal for controlling timing at which the exposing unit 5 forms an image and timing at which a toner image is transferred.

When the image forming apparatus is operated, voltage is applied to the charging roller 8 to negatively charge the surface of the photosensitive member 1 to a predetermined potential for the charged portion. An image portion on the charged photosensitive member 1 has a predetermined potential for the exposed portion by an exposing operation performed by the exposing unit 5. Thus, an electrostatic latent image is formed. The developing roller of the developing unit 10Y and the like is previously applied with a developing bias previously determined for each color. Thus, the latent image is developed with the toner at the time of passage through the position of the developing roller. The toner image is transferred to the belt 3 by the primary transfer roller 2, and then transferred to the recording paper by the secondary transfer roller 4 so as to be supplied to the fixing unit 24. When a full-color printing operation is performed, toners in the four colors are superimposed on the belt 3 so as to be transferred to the recording paper.

The developing roller of the above-mentioned image forming apparatus is a developing roller having a plurality of magnetic poles to utilize magnetic force to absorb a carrier which forms the developer together with the toner so that a magnetic brush is formed which supplies the toner absorbed to the carrier to the photosensitive member. magnetic lines of forces corresponding to the number of the magnetic poles are generated around the developing roller. The intensity of the magnetic force varies depending on the circumferential position on the developing roller. Therefore, the quantity of toner which is adsorbed by the developing roller varies depending on the position.

On the other hand, the gear of the drive motor for rotating the developing unit assembly and the gear of the developing unit assembly arranged to be engaged with the gear of the drive motor possess a backlash. Therefore, even if the drive motor is stopped at the reference position to fix each developing roller to a predetermined position with respect to the photosensitive member, the stopping position of the developing roller cannot be stabilized because of the backlash. As a result, the relative positions between the photosensitive member and the developing roller cannot be stabilized.

If the relative positions between the photosensitive member and the developing roller cannot be stabilized when the development is performed, the quantity of toner which is supplied to the photosensitive member varies depending on the relationship between the position of the developing roller and the quantity of the toner. As a result, there arises a problem in that the density of a formed image becomes unstable. FIG. 2 is a graph showing the examined relationship between the stopping positions of the developing roller and the densities of images. The stopping position is indicated with the distance realized on the surface of the photosensitive member from a straight line connecting the center of the developing unit assembly and that of the photosensitive member to each other to the point of contact between the developing roller and the photosensitive member. The distance in the direction of rotation of the photosensitive member is the positive direction, while the distance in the opposite direction is the negative direction. As shown in the graph, the density of the image is raised when the stopping position of the developing roller is shifted in the positive direction.

FIG. 3 is a perspective view showing the structure of a drive portion of the developing unit assembly 10. The rotary developing unit assembly 10 has a helical gear 78 secured coaxially with a main shaft 68 of the developing unit assembly 10. A helical gear 71 secured to a output shaft 70*a* of a step motor 70 is engaged with the helical gear 78 as shown in this figure. When a required developing unit is moved to a position opposite to the photosensitive member 1, a predetermined number of pulses are supplied to the step motor 70 so that the developing unit assembly 10 is rotated to a predetermined rotational position.

FIG. 4 is a diagram showing a method by which the developing unit assembly 10 is supported by a device frame 90. The developing unit assembly 10 has the main shaft 68, the both ends of which are rotatively supported by the device frame 90. The position of the developing unit assembly 10 in, for example, the axial direction, is fixed by engaging the stop ring 91 to the main shaft 68.

FIGS. 5 and 6 are schematic plan views each showing a state of engagement between the helical gear 78 of the developing unit assembly 10 and the helical gear 71 of the step motor 70. When the step motor 70 has been rotated to rotate the developing unit assembly 10, the helical gears 71 and 78 are operated as shown in FIG. 5 such that helical teeth 71*a* of the helical gear 71 (the step motor) push helical teeth 78*a* of the helical gear 78 (the developing unit assembly) in a direction of rotation.

The rotation of the step motor 70 is interrupted after the developing unit assembly 10 has been moved to the predetermined rotational position. Since inertia force is exerted on the developing unit assembly 10 in the direction of rotation, the developing unit assembly 10 cannot immediately be stopped. Therefore, when the step motor 70 is stopped, the helical teeth 78*a* of the helical gear 78 push the helical teeth 71*a* of the helical gear 71 by dint of the inertia force, as shown in FIG. 6.

At this time, inertial force W is exerted on the helical teeth 78*a* of the helical gear 78 in the direction of the rotation. Since the surface of contact between the helical teeth 71*a* and 78*a* is a smooth surface, vertical resistance N is exerted from the contact surface to the helical teeth 78*a*. Therefore, resultant force F is exerted on the helical gear 78 in parallel with the contact surface toward a direction shown in FIG. 6.

As described above, deviation of the developing unit assembly 10 in the axial direction is limited by the stop ring 91 engaged with the main shaft 68. However, the amount of deviation cannot completely be made to be zero because of existence of clearances and dimension tolerances. Therefore, when the resultant force F is produced, the helical gear 78 is displaced in parallel with the contact surface toward a direction indicated with an arrow Z shown in FIG. 3. Assuming that the distance of movement of the main shaft 68 along the contact surface is L and the helix angle of the helical teeth is θ, the main shaft 68 is advanced excessively by L•sin θ in the direction of the rotation. Therefore, the contact position of the developing unit with respect to the photosensitive member 1 is undesirably deviated by L•sin θ. Thus, there arises a problem in that irregularity in development and change in the density occur.

To solve the above-mentioned problem, the main shaft 68 of the developing unit assembly 10 must accurately be positioned with respect to the device frame 90. When the accurate positioning is performed, an adjustment operation and the like are required after the apparatus has been assembled. Thus, there arises a problem in that the manufacturing process is complicated.

SUMMARY OF THE INVENTION

It is therefore a first object of the present invention is to provide an image forming apparatus which is capable of stabilizing the relative positions between a photosensitive member and a developing roller thereof so as to prevent unstable densities of formed images.

And the second object of the present invention is to provide an image forming apparatus which is capable of accurately stopping a rotary developing unit assembly at a required rotational position without a necessity of performing an adjustment operation or the like.

In order to achieve the above object, there is provided an image forming apparatus for developing an electrostatic latent image formed on an image carrier, which is rotatable around an central shaft thereof, with plural colors of toner comprising: a developing unit assembly an outer peripheral portion of which retains a plurality of developing units each of which includes a developing roller being to be contacted with the image carrier to supply the associated color of the toner thereon, the developing unit assembly rotatable around a central shaft thereof; a first drive member for rotatively driving the developing roller positioned at a contact position of the developing roller and the image carrier; a second drive member for rotatively driving the developing unit assembly to subsequently position each of the developing roller at the contact position so a rotational direction of the developing unit assembly as to be opposed to a rotational direction of the developing unit assembly according to a reaction force derived from the driving of the first drive member.

The first drive member includes a first motor arranged separately from the developing unit assembly and a first gear mechanism for transferring a driving force of the first motor to the developing roller, and the second drive member includes a second motor arranged separately from the developing unit assembly and a second gear mechanism coaxially provided with the central shaft of the developing unit assembly for transferring a driving force of the second motor to the developing unit assembly.

Accordingly, even if the position of the developing unit assembly is shifted by the inertia thereof when the second drive member has been stopped at the reference position, the reaction force of the first drive member causes the developing unit assembly to be returned to the reference position.

The image forming apparatus further comprises a press member for elastically urging the developing unit positioned at the contact portion toward the image carrier, wherein the contact position is arranged more upstream than a line connecting the central axis of the developing unit assembly and the central axis of the image carrier in the rotational direction of the developing unit assembly.

Accordingly, even if the developing unit assembly continues the rotation by the inertia when the second drive member has been stopped at the reference position, the reaction force of the urging force generated by the press member inhibits the movement caused by the inertia so that the developing unit is stopped at the reference position.

The image forming apparatus further comprises a support member for rotatively supporting the central shaft of the developing unit assembly such that an axial displacement towards one end portion thereof is prevented elastically and an axial displacement towards the other end portion thereof is prevented fixatively.

The support member includes a fixative support member for supporting the one end portion fixatively in the axial direction to prevent the axial displacement toward the other end portion and a elastic support member for elastically attracting the central shaft toward the other end portion.

The support member may include a fixative support member for supporting the one end portion fixatively in the axial direction to prevent the axial displacement toward the other end portion and a elastic support member for elastically pressing the central shaft toward the other end portion.

The image forming apparatus further comprises a knob member coaxially provided with the central shaft for manually rotating the developing unit assembly, wherein the elastic support member is disposed inside the knob member.

Accordingly, it is possible to completely prevent the axial displacement of the central shaft toward the other end portion occurring when the central shaft is rotatively supported even if a clearance exists in the axial direction. Moreover, displacement toward the one end portion can be prevented unless the force which is larger than the elastic force of the elastic support member is exerted. Therefore, any adjustment operation for reducing the clearance of the central shaft is not required to prevent deflection of the central shaft in the axial direction. As a result, the developing unit assembly can accurately be stopped at a required rotational position.

DETAILED DESCRIPTION OF THE PREFERRED EMBODIMENTS

Figure 1:
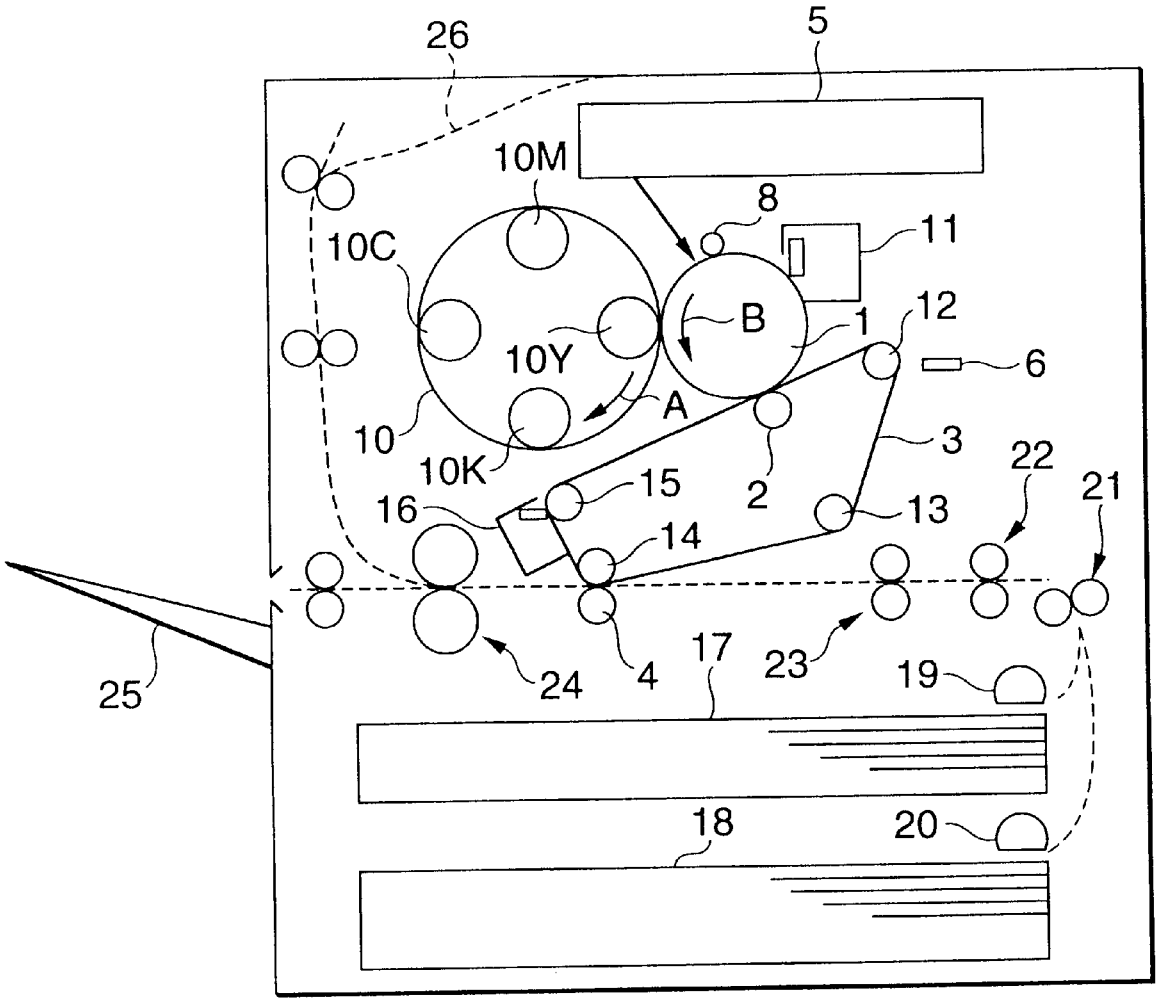
FIG. 1 is a schematic view showing the overall structure of an image forming apparatus.
Figure 2:
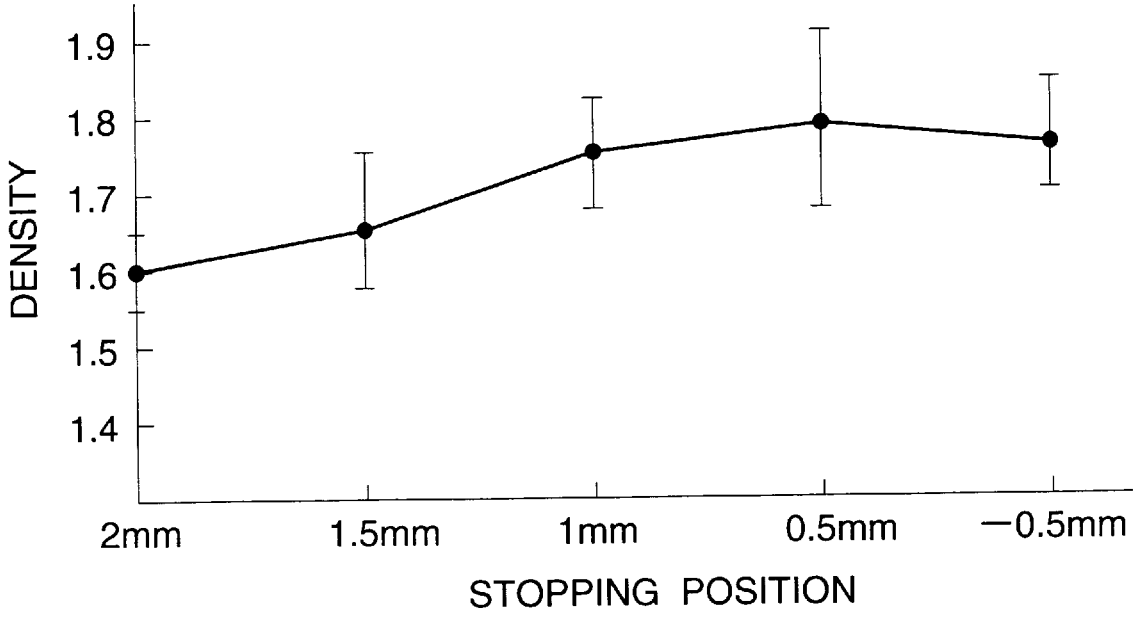
FIG. 2 is a diagram showing a relationship between deviation of stopping positions of a developing roller and densities of formed images.
Figure 7:
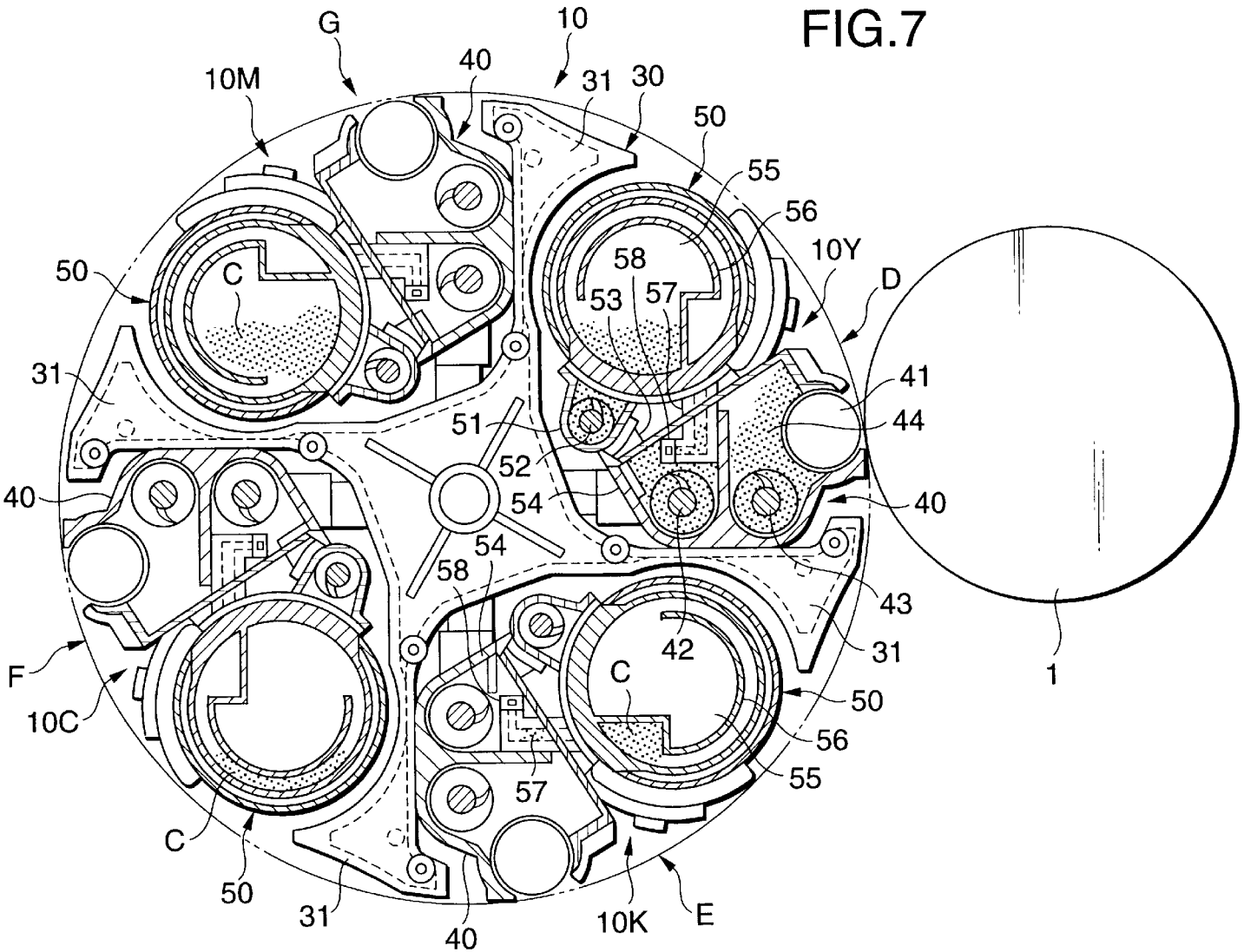
FIG. 7 is a cross sectional view showing the structure of the developing unit assembly.

Referring to the accompanying drawings, the present invention will now be described. This embodiment is one example of application of the present invention to the image forming apparatus described with reference to FIG. 1. Therefore, reference is made to FIG. 1, if necessary. FIG. 7 is a cross sectional view showing one example of the rotary developing unit assembly 10. Developing devices 10Y, 10M, 10C and 10K capable of displacing in a direction in which the arm 31 is expanded are mounted on the arm 31 of the rotative side frames 30 (as described later). Since the developing devices 10Y, 10M, 10C and 10K have the same structures, the developing device 10Y will now be described as a representative developing device. The developing device 10Y incorporates a developing unit 40 and a developer cartridge 50. The developing unit 40 accommodates a magnet roller, that is, a developing roller 41, the longitudinal direction of which is a direction (hereinafter simply called a "axial direction") of the axis of rotation of the side frames 30 and two spiral augers 42 and 43 extending in parallel with the developing roller 41. When the developing roller 41 has been rotated, the spiral auger 42 stirs and moves the developer 44 accommodated in the developing unit 40 in the axial direction.

On the other hand, the spiral auger 43 stirs and moves the developer 44 in a direction opposite to the direction of movement performed by the spiral auger 42 so as to supply the developer 44 to the developing roller 41. The developing roller 41 adsorbs carriers contained in the developer 44 to form a magnetic brush so as to supply toner adsorbed to the carriers to the photosensitive member 1. As a result, an electrostatic latent image formed on the photosensitive member 1 is formed into a visible image.

The developer cartridge 50 is in the form of a cylindrical container, the lengthwise direction of which is the above-mentioned axial direction, and which is sectioned into a chamber for accommodating new developer and a chamber for recovering the degenerated developer. The chamber for the new developer has a supply port (not shown). Thus, the communication is, through the supply port, established with a cylindrical casing 51 for introducing the new developer into the developing unit 40. The casing 51 accommodates a spiral auger 52 so that the supplied developer is introduced into a supply opening 53 by the spiral auger 52 so as to be introduced into the developing unit 40. A flap 54 is disposed at an outlet portion of the supply opening 53, the flap 54 being opened when the developing device is at position D.

A degenerated-developer recovery chamber 55 of the developer cartridge 50 has a recovery passage 56 formed in the inside portion of the developer cartridge 50. A discharge pipe 57 is connected to the recovery passage 56. The discharge pipe 57 is bent into a dogleg shape such that a recovery opening 58 formed at the leading end of the discharge pipe 57 projects into the developing unit 40. The recovery opening 58 faces an upstream position of the supply opening 53 (in a direction in which the developer is moved). Thus, the developer stirred and moved by the spiral augers 42 and 43 so as to be, one time, moved around the inner portion of the developing unit 40 is recovered through the supply opening 53.

The rotary developing device having the developing devices 10K, 10C and 10M each having the same structure as that of the developing device 10Y has the flap 54 which opens the supply opening 53 when the developing unit is positioned at the position D. If necessary, a new developer is supplied into the developing unit 40. After a latent image formed on the photosensitive member 1 has been developed by the developing device 10Y, the rotative member is rotated to move the developing device to a position adjacent to position E. Thus, the flap 54 is opened half as illustrated. Moreover, the recovery opening 58 is allowed to face upwards. As a result, any counterflow of the developer which is moved in the discharge pipe 57 can be prevented. Thus, the developer flows toward the recovery passage 56. The degenerated developer is allowed to pass through the recovery passage 56 so as to be downwards introduced into the degenerated-developer recovering chamber in a period in which the developing device is moved from position F to position G. Since the recovery passage 56 formed around the inside portion as described above is provided, any counterflow of the developer which must be recovered to the developing unit 40 can be prevented.

In a period in which the developing device is moved from the position G to the position D, an agitator (not shown) provided in the developer cartridge 50 sends the new developer to the casing 51. The spiral auger 52 in the casing 51 introduces the new developer to the supply opening 53. Since the flap 54 is again opened at this time, the new developer is supplied into the developing unit 40.

Figure 8:
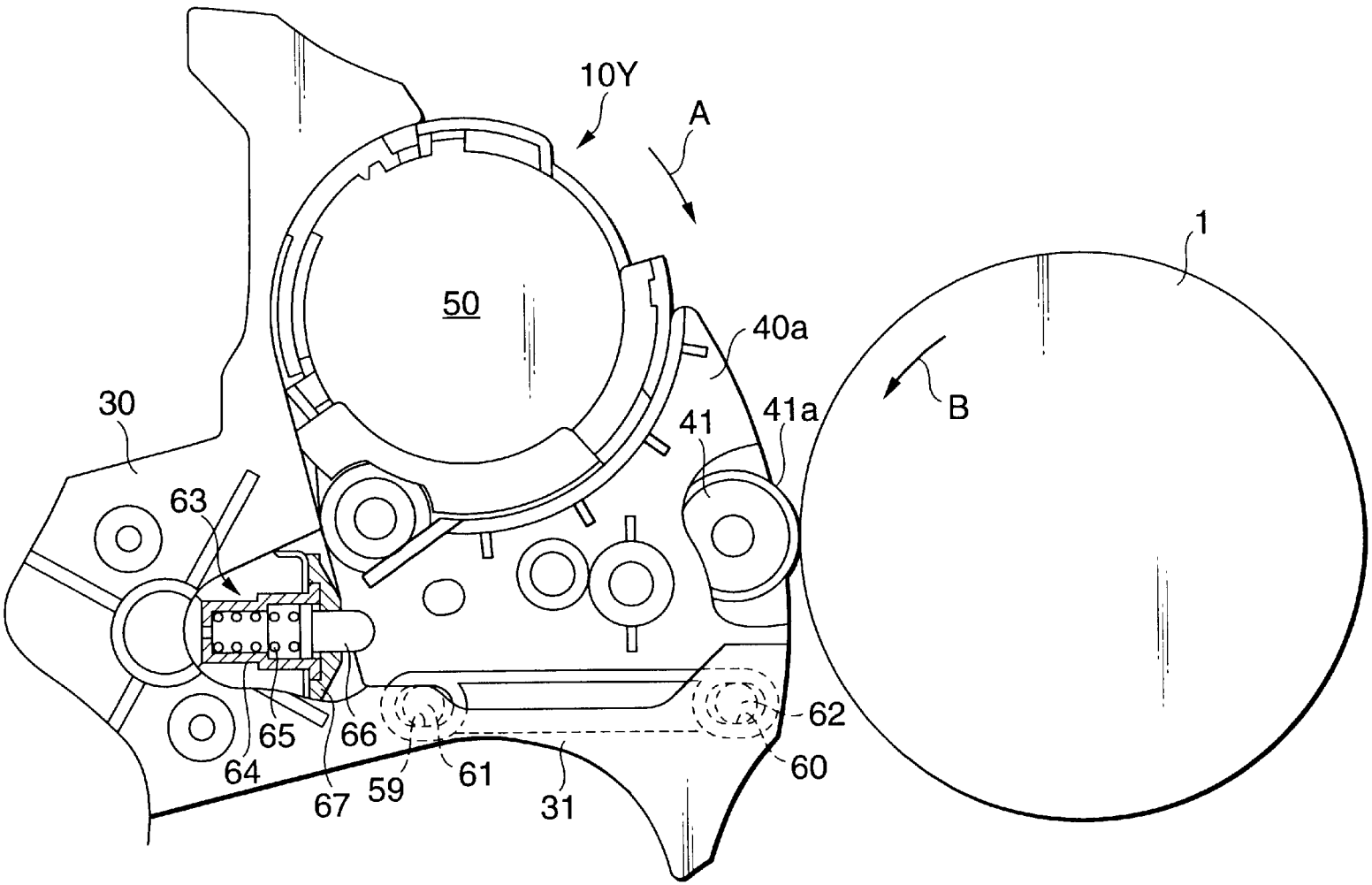
FIG. 8 is an enlarged view showing the structure of an essential portion of the developing unit assembly.

The developing device 10Y and the like are elastically urged in the direction of the photosensitive member 1. Referring to FIG. 8, an urging member and an urging direction will now be described. FIG. 8 is an enlarged view showing an essential portion of the developing unit assembly 10 to describe the member for urging the developing device 10Y. The developing roller 41 faces the photosensitive member 1 through a tracking roller 41*a* such that an appropriate gap (for example, 0.5 mm) is maintained. Slots 59 and 60 are formed in the side surface of a housing 40*a* of the developing unit 40. Pins 61 and 62 secured to the arm 31 of the side frames 30 are engaged with the slots 59 and 60. Similar slots and pins are provided for the other side face of the developing unit 40 and a rotary flange (to be described later) positioned opposite to the other side face. That is, the housing 40*a* holding the developing roller 41 is supported by the side frames 30 through the pins 59 and 60.

A pressing unit 63 for urging the housing 40*a* toward the photosensitive member 1 is disposed in the rear of the housing 40*a*. The pressing unit 63 incorporates a cylindrical member 64 secured to a main frame (a structure disposed perpendicular to the faces of the side frames and joining the side frames 30 to each other); a compression coil spring 65 accommodated in the cylindrical member 64; and a pressing pin 66 which is urged by the compression coil spring 65. A cover 67 mounted on the cylindrical member 64 to prevent separation of the pressing pin 66 from the cylindrical member 64 limits the stroke. The leading end of the pressing pin 66 abuts against the rear portion of the housing 40*a* so as to forwards push the housing 40*a*, that is, toward the photosensitive member 1 by the elastic force of the compression coil spring 65.

In a state in which the tracking roller 41*a* is in contact with the photosensitive member 1 at a predetermined position, that is, at the developing position, the tracking roller 41*a* is slightly pushed rearwards by the photosensitive member 1. Thus, gaps are produced between the slots 59 and 60 and the pins 61 and 62, the gaps being produced adjacent to the photosensitive member 1. Namely, the tracking roller 41*a* and the photosensitive member 1 are in contact with each other by the force for rearwards pushing the compression coil spring 65 for the stroke corresponding to the gap.

Figure 3:
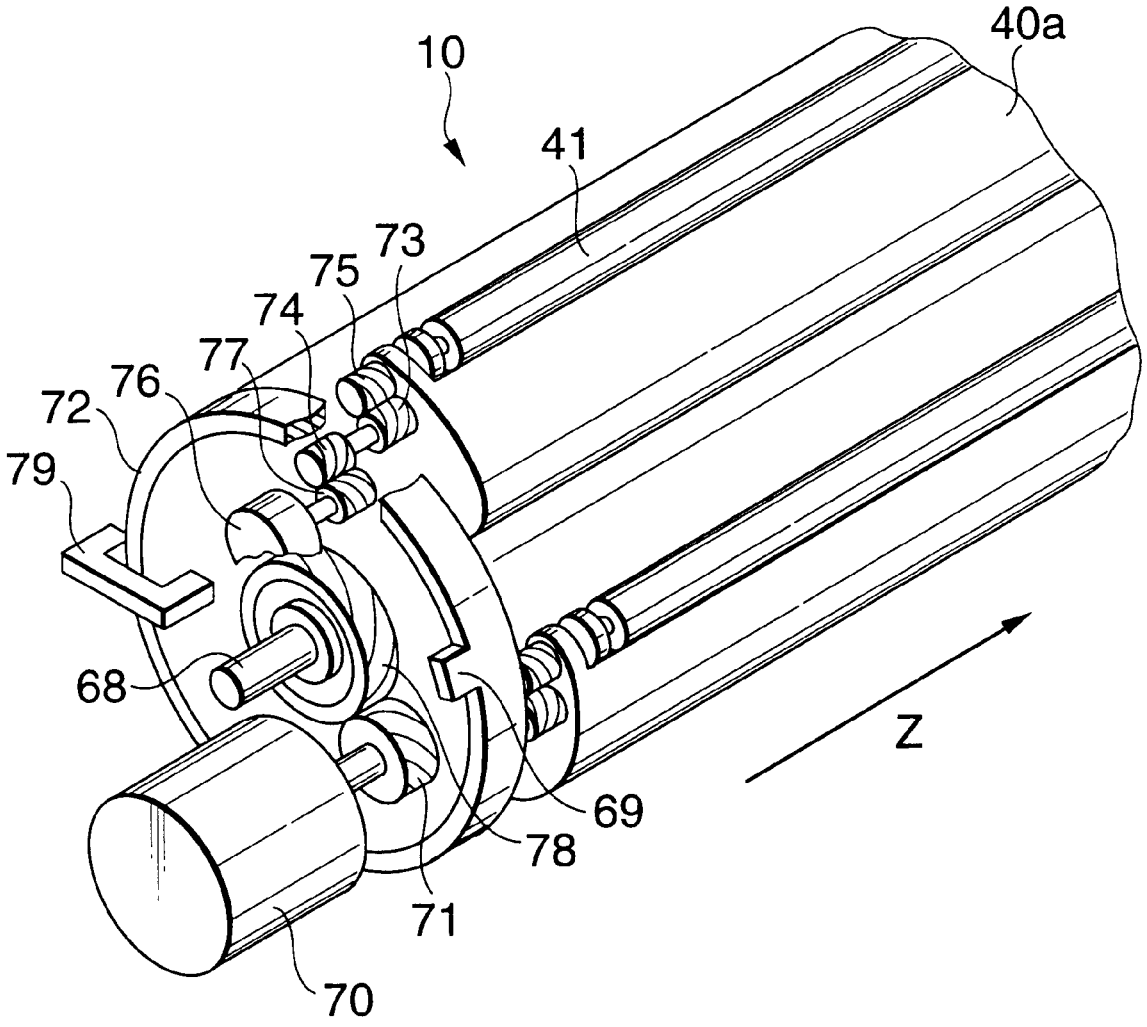
FIG. 3 is a perspective view showing a developing unit assembly included in the image forming apparatus.

A structure for rotating the developing unit assembly 10 will now be described with reference to FIG. 3. The helical gear 78 is disposed at an end of the developing unit assembly 10 such that the helical gear 78 is coaxial with the main shaft 68 which is the center of rotation of the developing unit assembly 10. The helical gear 71 joined to the output shaft 70*a* of the step motor 70 is engaged with the helical gear 78. The main shaft 68 is borne by a main body (not shown) so as to be rotated in the direction A shown in FIG. 1 by the step motor 70.

The main shaft 68 is secured to a rotary flange 72. Gears 73 and 74 for rotating the developing roller 41 are rotatively supported by the rotary flange 72. That is, a common shaft for the gears 73 and 74 penetrates the rotary flange 72. The gears 73 and 74 are secured to the both ends of the common shaft. The gear 73 is engaged with a gear 75 secured to an end of the developing roller 41.

A motor 76 for the developing unit (not shown) is provided. A gear 77 secured to the output shaft of the motor 76 for the developing unit is positioned so as to be engaged with the gear 74 when the developing unit assembly 10 has been stopped at the predetermined developing position, that is, when the developing roller 41 has been stopped at a position at which the contact with the photosensitive member 1 is made.

A projecting actuator 69 is formed on an end surface of the rotary flange 72. When the actuator 69 interrupts an optical axis of an optical sensor 79, a detection signal is output. The output signal from the optical sensor 79 is a signal (a reference position signal) indicating the reference position of the developing unit assembly 10 in the direction of the rotation. In response to the reference position signal, the stopping position for the developing unit assembly 10 is determined.

For example, the position (a home position) when a developing operation is not performed is a position rotated by an angular degree of 47.25° from output of the reference position signal. When a step motor which is advanced by an angular degree of 0.225° per pulse is employed as the step motor 70, the home position is a position corresponding to 210 pulses supplied from the output of the reference position signal.

The developing position is a position advanced by, for example, 30.15° from the home position. When advancement corresponding to 134 pulses is made from the home position, the developing unit assembly 10 is stopped for performing the development. Then, the developing unit assembly 10 is sequentially rotated by 90° each for causing the developing units in the colors to perform development.

Figure 9A:
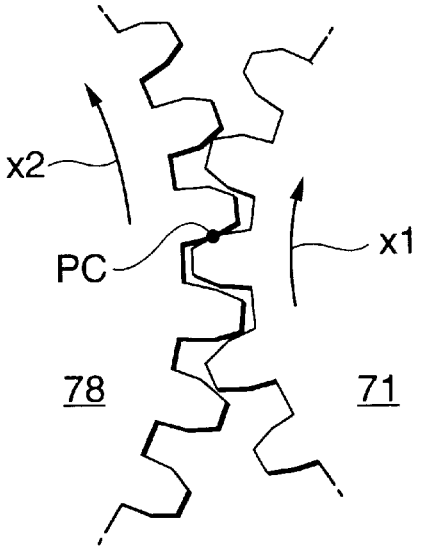
FIGS. 9A and 9B are diagrams showing states of engagement of the helical gears.
Figure 9B:
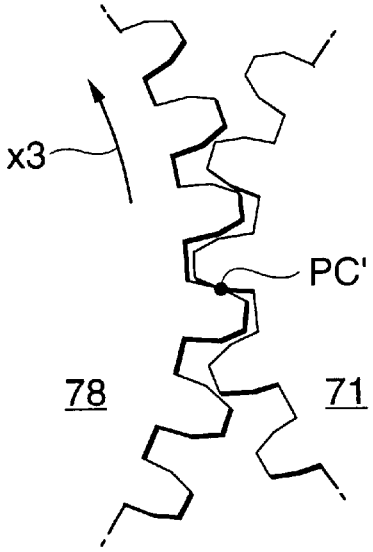

A state of engagement between the helical gear 71 of the step motor 70 and the helical gear 78 adjacent to the developing unit assembly 10 is shown in FIGS. 9A and 9B. The helical gear 71 and 78 smoothen the rotations and prevent noise. FIG. 9A is a diagram showing a state of the engagement when both of the helical gear 71 and 78 are being rotated. When the helical gear 71 is being rotated in a rotating direction x1 and the helical gear 78 is being rotated in a direction indicated by an arrow x2, their contact point PC is a position of the contact between the front face of the helical gear 71 and the rear face of the helical gear 78.

When the rotation of the step motor 70 has been interrupted at the developing position, the helical gear 71 and 78 are not necessarily in contact with each other as shown in FIG. 9A. That is, a backlash occurs between the helical gear 71 and 78. Therefore, the stopping position varies in the range of the backlash. For example, the inertia of the developing unit assembly 10 causes the helical gear 78 to be rotated in a direction indicated by an arrow x3. Thus, there is possibility that the contact point between the rear face of the helical gear 71 and the front face of the helical gear 78 is contact point PC', as shown in FIG. 9B.

Figure 10:
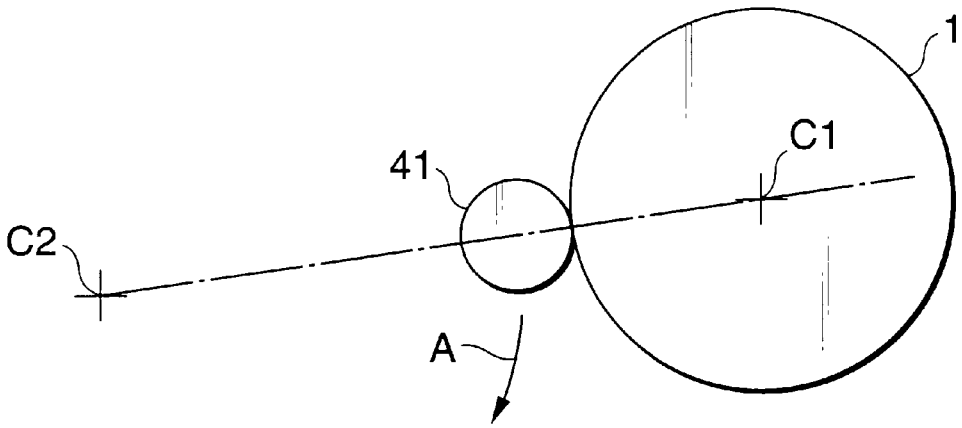
FIG. 10 is a schematic view showing the position of contact between a developing roller and an image carrier of the related apparatus.

In the following state, deviation of the position caused from the backlash is maximized. FIG. 10 is a diagram showing a state of the contact between the developing roller 41 and the photosensitive member 1. An assumption is made in the foregoing drawing that the position of the contact between the developing roller 41 and the photosensitive member 1 exists on a straight line connecting center C1 of the photosensitive member 1 and center C2 of the developing unit assembly 10 to each other. In the foregoing case, even after the step motor 70 has been stopped at the predetermined position, the developing unit assembly 10 is displaced in the direction A by dint of the inertia thereof. Thus, the developing roller 41 is undesirably moved across the predetermined contact position. The developing device 10Y and the like are being urged toward the photosensitive member 1 as described above. Therefore, if the developing roller 41 has been moved across the predetermined contact position, the developing unit assembly 10 is further urged in a direction across the contact position owning to the reaction force of the urging force. As a result, the helical gear 71 and 78 are brought to a state shown in FIG. 9B when the developing operation is performed. Thus, the deviation of the contact position between the developing roller 41 and the photosensitive member 1 is maximized.

To prevent deviation of the contact position and enable the developing roller 41 and the photosensitive member 1 to be always brought into contact with each other at a stable position, the following structure is employed. When development is performed, the gear 77 of the motor 76 for the developing unit is engaged with the gear 74 so that the developing roller 41 is rotated. Since the gear 74 is borne by the rotary flange 72, the rotation of the motor 76 for the developing unit causes rotational force, which is the reaction force, to be as well as imparted to the rotary flange 72. Thus, the overall body of the developing unit assembly 10 is rotated.

When the rotating direction of the developing unit assembly 10 realized by the rotation of the motor 76 for the developing unit is opposite to the rotating direction caused by the inertia of the developing unit assembly 10, the engagement between the helical gear 71 and 78 is brought to a state shown in FIG. 9A. When the rotating direction of the developing unit assembly 10 realized by the rotation of the motor 76 for the developing unit is the same as the rotating direction realized by the inertia of the developing unit assembly 10, the engagement between the helical gear 71 and 78 is brought to a state shown in FIG. 9B.

Figure 11:
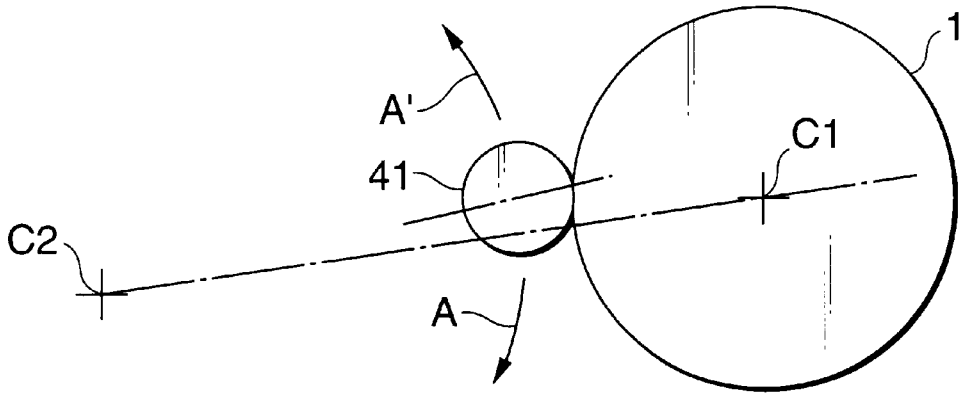
FIG. 11 is a schematic view showing a point of contact between the developing roller and an image carrier according to one embodiment of the present invention.

Therefore, the state of the engagement between the helical gears 71 and 78 realized when the step motor 70 has been stopped is attempted to be maintained when the development is performed. To maintain the state, the direction in which the developing unit assembly 10 is rotated by the motor 76 for the developing unit and the direction in which the developing unit assembly 10 is rotated by the step motor 70 are made to be opposite to each other. An assumption is made that the direction in which the developing unit assembly 10 is rotated by the step motor 70 is the direction A (see FIG. 11). To cause the direction in which the developing unit assembly 10 bearing the gears 73 and 74 is rotated by the reaction force of the rotation of the motor 76 for the developing unit to be opposite (called direction A') to the direction A, the structure of the gear unit including the gears 73 and 74 is determined.

When the contact position between the developing roller 41 and the photosensitive member 1 exists on a straight line connecting the center of the developing unit assembly 10 and the photosensitive member 1 to each other as described above, the deviation of the position is maximized between the position caused when the step motor 70 has been stopped and that caused when the development is performed. Therefore, the structure is arranged such that the developing roller 41 and the photosensitive member 1 are brought into contact with each other at a position upstream of the straight line connecting the center of the developing unit assembly 10 and the photosensitive member 1 to each other in the direction of rotation of the developing unit assembly 10.

Figure 5:
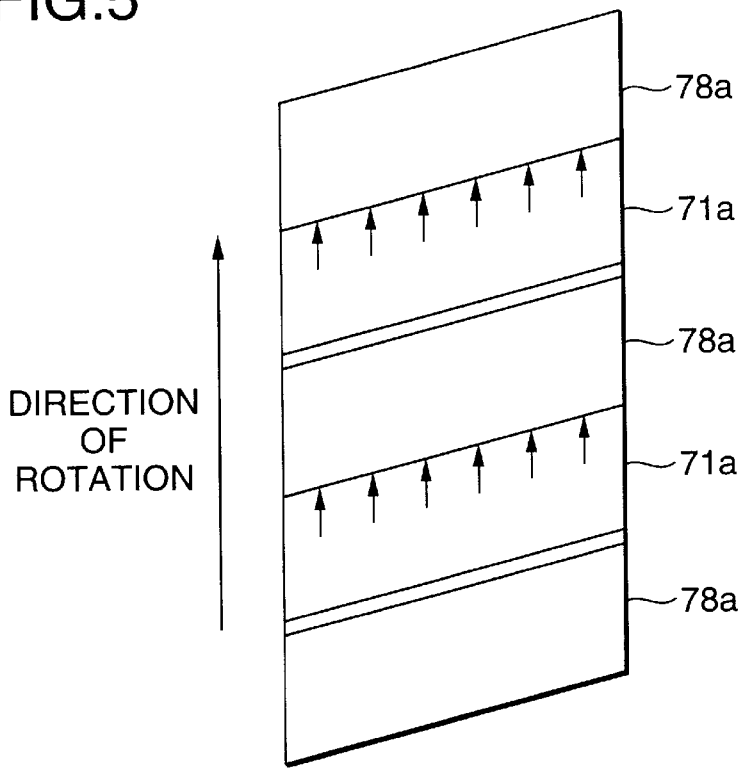
FIG. 5 is a schematic plan view showing a state of engagement between a helical gear of the multicolor developing unit and a helical gear of a step motor established when rotation is performed.
Figure 6:
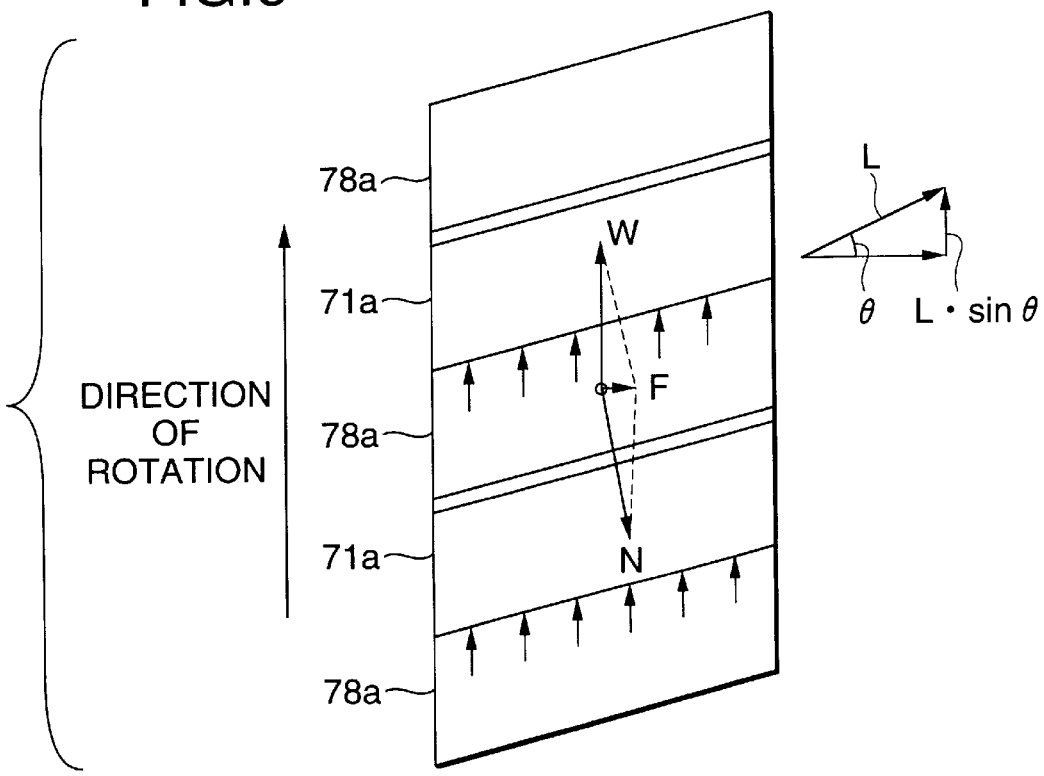
FIG. 6 is a schematic view showing a state of engagement between the helical gear of the multicolor developing unit and the helical gear of the step motor established immediately after interruption of the rotation.

FIG. 5 is a diagram showing a state in which the developing roller 41 and the photosensitive member 1 have been brought into contact with each other at a position upstream of the straight line connecting the center of the developing unit assembly 10 and the photosensitive member 1 to each other in the direction of rotation of the developing unit assembly 10. Referring to the drawing, when the step motor 70 has been stopped after supply of a predetermined number of pulses from a moment of time corresponding to the home position, the reaction force of the urging force of the developing device 10Y or the like is imparted to the developing unit assembly 10. Thus, the force for rotating in the direction indicated by the arrow A' is imparted to the developing roller 41. The force in the direction A' is exerted in the opposite direction to the direction (the direction A) of the inertia of the developing unit assembly 10 when the step motor 70 has been stopped. That is, the force is exerted in a direction in which the deviation of the positions corresponding to the backlash of the helical gears 71 and 78 is prevented.

Figure 4:
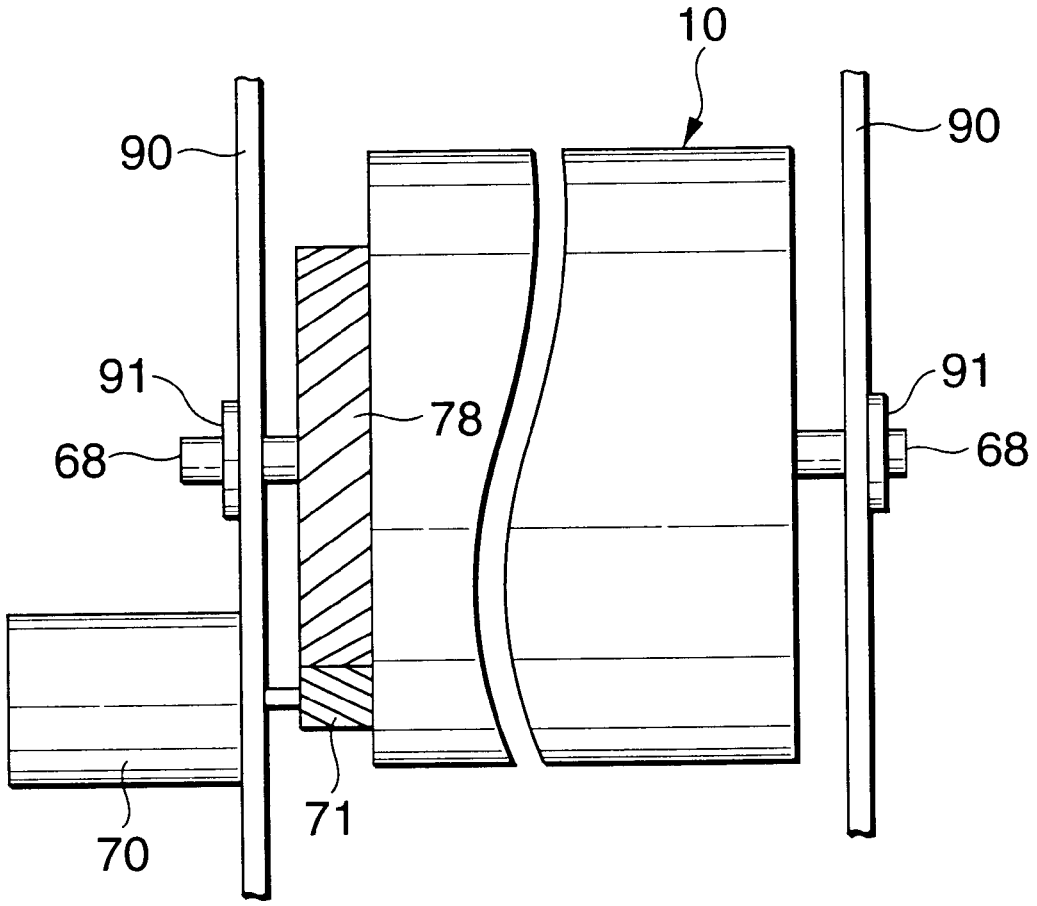
FIG. 4 is a diagram showing a related method of supporting the developing unit assembly.
Figure 12:
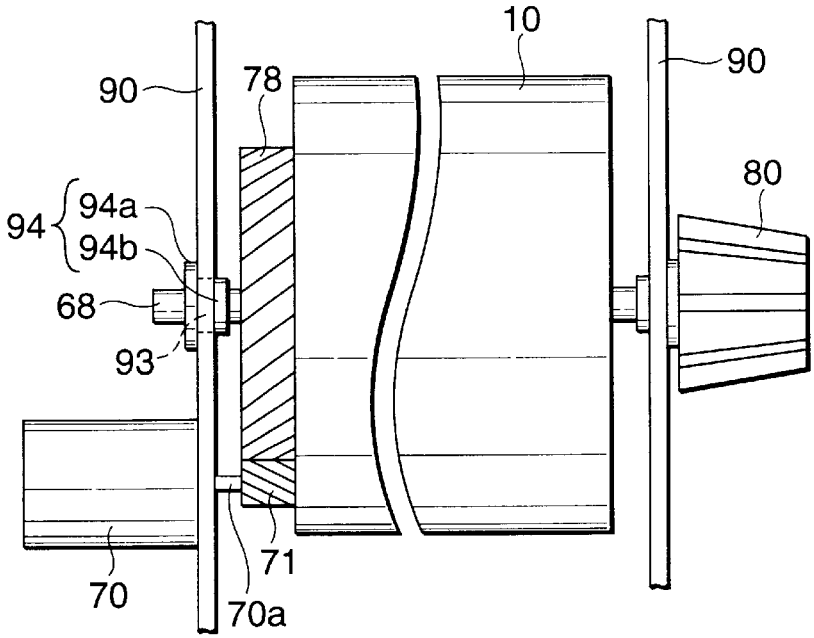
FIG. 12 is a diagram showing a method of supporting the developing unit assembly according to the embodiment of the present invention.

FIG. 12 is a diagram showing a method by which the developing unit assembly 10 according to the present invention is supported by the device frame 90. The same reference numerals as those described in the previous description represent the same or similar elements shown in FIG. 4.

A resin slide bearing 94 consisting of, for example, a large-diameter portion 94*a* and a small-diameter portion 94*b* is secured to one end (in the left-hand portion of the drawing) of the main shaft 68 of the developing unit assembly 10. The small-diameter portion 94*b* is inserted into a shaft hole 93 formed in the device frame 90 so that the main shaft 68 is rotatively supported in such a manner that displacement toward the other end (in the right-hand portion of the drawing) is limited by the large-diameter portion 94*a*. The other end of the main shaft 68 is supported rotatively with respect to the device frame 90 by a knob 80 accommodating an elastic support member for attracting the main shaft 68 to the direction of the other end by the elastic force of a spring.

Figure 13:
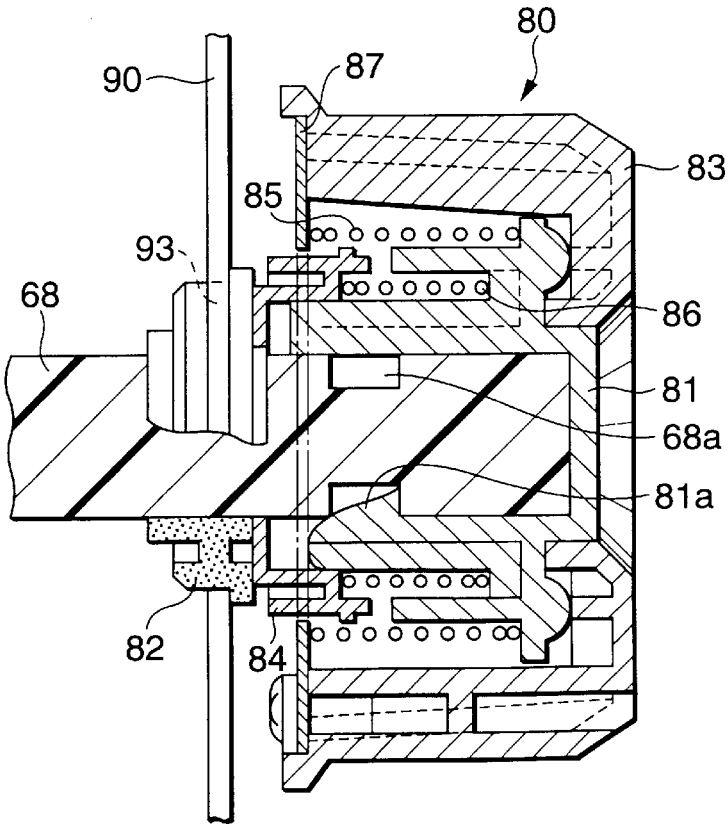
FIG. 13 is a diagram showing a rotational knob according to the embodiment of the present invention.
Figure 14:
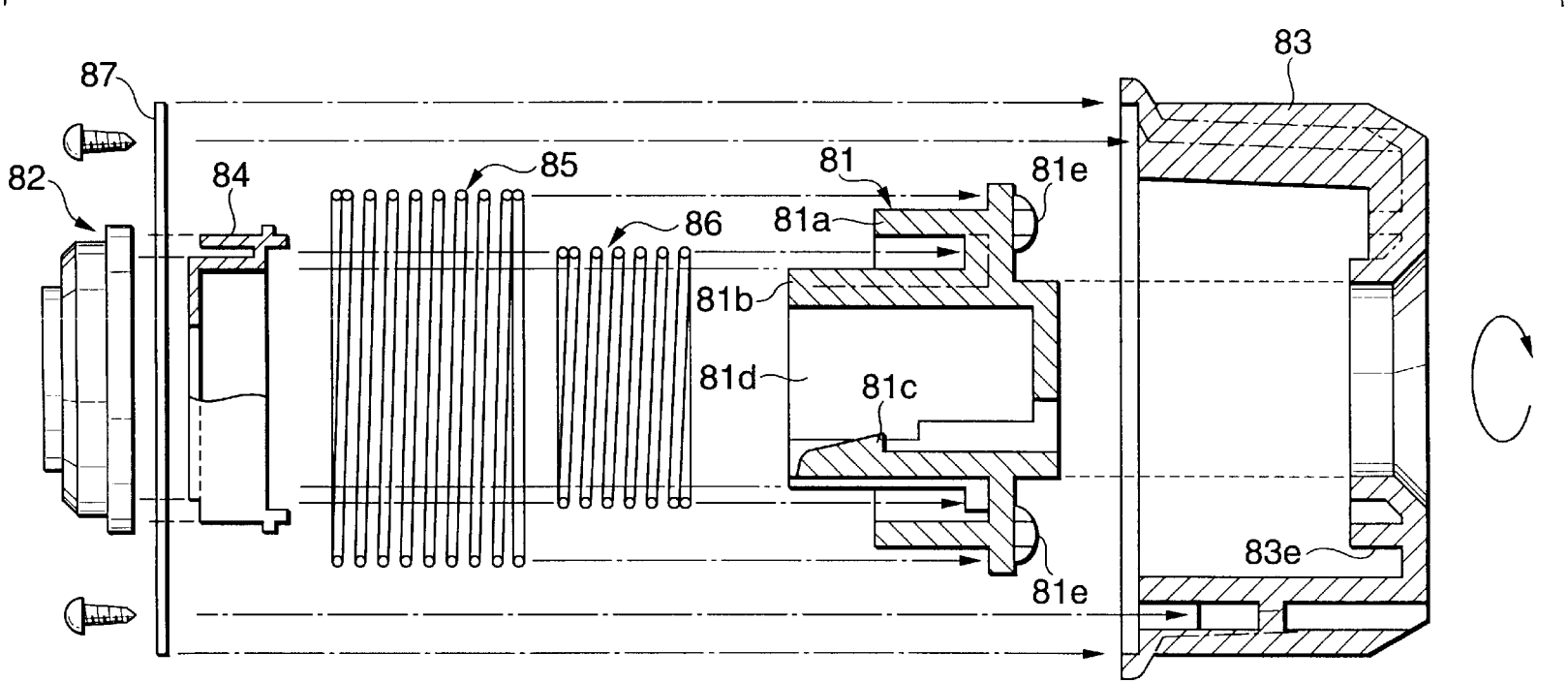
FIG. 14 is a decomposed view showing the rotational knob according to the embodiment of the present invention.

FIG. 13 is a cross sectional view showing the knob 80 accommodating the elastic support member. FIG. 14 is a diagram showing an assembled state to illustrate the structure.

The knob 80 according to this embodiment incorporates a screw member 81 arranged to be engaged and secured to the side portion of the other end of the main shaft 68 of the developing unit assembly 10; a cap-shape grip 83 disposed to cover the screw member 81; a ring-shape plate 87 screwed to an opened end of the grip 83; a spring 85 disposed around an outer cylindrical portion 81*a* of the screw member 81 to elastically press the screw member 81 against the plate 87 in a direction toward the grip 83; a spring 86 disposed around an inner cylindrical portion 81*b* of the screw member 81 to elastically press the slide bearing 84 against the screw member 81 in a direction toward the plate 87; and a resin support cap 82 inserted into the shaft hole 93 of the device frame 90 to rotatively support the slide bearing 84.

A claw 81*c*, which is engaged to a groove 68*a* formed at an end portion of the main shaft 68, elastically projects into a shaft hole 81*d* of the screw member 81. Therefore, when the main shaft 68 of the developing unit assembly 10 is inserted into the shaft hole 81*d* of the screw member 81, the claw 81*c* is engaged to the groove 68*a* of the main shaft 68, as shown in FIG. 13. Thus, the screw member 81 is secured to the main shaft 68.

[0025]

A plurality of projections 81*e* each axis of which is in parallel with that of the shaft hole 81*d* are formed on the end face of the screw member 81 adjacent to the grip 83. A projection 83*e* arranged to be engaged to the projection 81*e* to constitute a clutch mechanism together with the spring 85 is formed on the inside of the grip 83. The clutch mechanism enables the main shaft 68 to be rotated in the same direction as the rotation of the grip 83 when the grip 83 is manually rotated in the direction indicated with an arrow. When the grip 83 is inversely rotated in a direction opposite to the direction indicated with the arrow, only the grip 83 can inversely be rotated without rotation of the main shaft 68.

On the other hand, the screw member 81 is elastically urged against the slide bearing 84 by the elastic force of the spring 86. Therefore, the main shaft 68 of the developing unit assembly 10 is always attracted toward the other end (to the right-hand portion in the drawing) by the elastic force of the spring 86. Displacement of the end of the main shaft 68 toward the other end is fixedly prevented by the large-diameter portion 94*a* of the slide bearing 94. Therefore, the main shaft 68 is always maintained at a limit position determined by the position, at which the slide bearing 94 is fixed, and shown in the right-hand portion in the drawing by dint of the elastic force of the spring 86.

Even if a clearance in the axial directional exists when the main shaft 68 of the developing unit assembly 10 is supported rotatively with respect to the device frame 90, displacement of the main shaft 68 toward the other end can completely be prevented by the slide bearing 94. Also displacement toward the one end can completely be prevented unless the force larger than the elastic force is exerted by the knob 80. Therefore, an adjustment operation or the like for the purpose of reducing the play of the main shaft 68 is not required when deflection of the main shaft 68 in the axial direction is prevented. As a result, the developing unit assembly 10 can accurately be stopped at a required rotational position.

In the foregoing embodiment, the one end of the main shaft 68 is rotatively supported by the slide bearing 94 such that its displacement toward the other end is fixedly prevented. Moreover, the elastic support member (the knob 80) for always attracting the main shaft 68 toward the other end by dint of the elastic force of the spring supports the other end of the main shaft 68. A converse structure may be employed in which the end of the main shaft 68 is rotatively supported such that its displacement toward the end is fixedly prevented. Moreover, the elastic support member for always pressing the main shaft 68 toward the one end by dint of the elastic force of the spring rotatively supports the one end of the main shaft 68.

And of course, any modifications or variation of the above embodiments can be realized without departing from the sprit and scope of the present invention.

As has been described heretofore, according to the present invention, when the developing unit assembly has been stopped at the developing position, movement of the developing unit assembly across a predetermined stopping position owning to the inertia can be prevented. Therefore, variation in the density of the formed image caused from deviation of the stopping position can be reduced.

According to the present invention, the main shaft of the developing unit assembly is rotatively supported while displacement of the main shaft in the axial direction thereof according to existence of a clearance is fixedly prevented. Also displacement toward the other end can completely be prevented unless force larger than the elastic force generated by the elastic member in the support member is exerted. Therefore, any adjustment operation for reducing the clearance of the main shaft is not required when axial directional deflection of the main shaft is prevented. As a result, the multicolor developing unit can accurately be stopped at a required rotational position.

According to the present invention, since the elastic support member is disposed in the knob, the multicolor developing unit can accurately be stopped at a required rotational position without enlargement of the apparatus.

What is claimed is:

1. An image forming apparatus for developing an electrostatic latent image formed on an image carrier, the image carrier being rotatable around an central shaft thereof, the image forming apparatus comprising:

a developing unit assembly having a plurality of developing units at an outer peripheral portion thereof, each of the developing units including a developing roller to be contacted with the image carrier to supply a color of toner, the developing unit assembly being rotatable around a central shaft thereof;

a first drive member coupled to the developing roller, for rotatively driving the developing roller and positioning the developing roller at a contact position with the image carrier, the contact position being arranged more upstream than a line connecting the central axis of the developing unit assembly and the central axis of the image carrier in the rotational direction of the developing unit assembly;

a second drive member coupled to the developing unit assembly, for rotatively driving the developing unit assembly to subsequently position each of the developing roller at the contact position, the second drive member rotatively driving the developing unit assembly in a rotational direction opposite of a rotational direction of the developing unit assembly by a reaction force derived from the driving of the first drive member.

2. The image forming apparatus as set forth in claim 1, wherein the first drive member includes a first motor arranged separately from the developing unit assembly and a first gear mechanism for transferring a driving force of the first motor to the developing roller, and the second drive member includes a second motor arranged separately from the developing unit assembly and a second gear mechanism coaxially provided with the central shaft of the developing unit assembly for transferring a driving force of the second motor to the developing unit assembly.

3. The image forming apparatus as set forth in claim 1 further comprising:

a press member for elastically urging the developing unit positioned at the contact portion toward the image carrier.

4. The image forming apparatus as set forth in claim 1 further comprising:

a support member for rotatively supporting the central shaft of the developing unit assembly such that an axial displacement towards one end portion thereof is prevented elastically and an axial displacement towards the other end portion thereof is prevented fixatively.

5. The image forming apparatus as set forth in claim 4, wherein the support member includes a fixative support member for supporting the one end portion fixatively in the axial direction to prevent the axial displacement toward the other end portion and an elastic support member for elastically attracting the central shaft toward the other end portion.

6. The image forming apparatus as set forth in claim 5 further comprising:

a knob member coaxially provided with the central shaft for manually rotating the developing unit assembly, wherein the elastic support member is disposed inside the knob member.

7. The image forming apparatus as set forth in claim 4, wherein the support member includes a fixative support member for supporting the one end portion fixatively in axial direction thereof to prevent the axial displacement toward the other end portion and a elastic support member for elastically pressing the central shaft toward the other end portion.

8. The image forming apparatus as set forth in claim 7 further comprising:

a knob member coaxially provided with the central shaft for manually rotating the developing unit assembly, wherein the elastic support member is disposed inside the knob member.

* * * * *

UNITED STATES PATENT AND TRADEMARK OFFICE

CERTIFICATE OF CORRECTION

PATENT NO. : 6,023,599
DATED : February 8, 2000
INVENTOR(S) : Satoshi MATSUZAKA et al.

It is certified that error appears in the above-identified patent and that said Letters Patent is hereby corrected as shown below:

On the Title Page, Item [57], in the Abstract,

Line 3, "an central" should read --a central--;

Line 6, after "roller", delete "being"; and

Line 13, "roller" should read --rollers--.

Claim 1, col. 12, line 36, "an central" should read --a central--.

Claim 1, col. 12, line 55, "roller" should read --rollers--.

Claim 7, col. 14, line 12, "a elastic" should read --an elastic--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*